US007338566B2

(12) United States Patent
Konishi et al.

(10) Patent No.: US 7,338,566 B2
(45) Date of Patent: Mar. 4, 2008

(54) ALLOY FOR SM-CO BASED MAGNET, METHOD FOR PRODUCTION THEREOF, SINTERED MAGNET AND BONDED MAGNET

(75) Inventors: Kenji Konishi, Saga (JP); Kazumasa Shintani, Glendale, AZ (US)

(73) Assignee: Santoku Corporation, Kobe-shi (JP)

( * ) Notice: Subject to any disclaimer, the term of this patent is extended or adjusted under 35 U.S.C. 154(b) by 560 days.

(21) Appl. No.: 10/494,677

(22) PCT Filed: Nov. 8, 2002

(86) PCT No.: PCT/JP02/11699

§ 371 (c)(1),
(2), (4) Date: May 3, 2004

(87) PCT Pub. No.: WO03/040421

PCT Pub. Date: May 15, 2003

(65) Prior Publication Data

US 2004/0244876 A1 Dec. 9, 2004

(30) Foreign Application Priority Data

Nov. 9, 2001 (JP) ..... 2001-344975

(51) Int. Cl.
*H01F 1/055* (2006.01)
*H01F 1/008* (2006.01)

(52) U.S. Cl. ..... 148/101; 148/103

(58) Field of Classification Search ..... None
See application file for complete search history.

(56) References Cited

U.S. PATENT DOCUMENTS 3,844,851 A * 10/1974 Haberer ..... 148/103
4,075,042 A * 2/1978 Das ..... 148/103
4,076,561 A * 2/1978 Lee et al. ..... 148/103
4,664,723 A * 5/1987 Ishii et al. ..... 148/301
4,863,511 A * 9/1989 Ishii et al. ..... 75/348
5,057,165 A * 10/1991 Nagata et al. ..... 148/102
5,164,023 A * 11/1992 Tabaru et al. ..... 148/101
6,001,272 A * 12/1999 Ikuma et al. ..... 252/62.54
6,143,193 A * 11/2000 Akioka et al. ..... 252/62.55
2002/0054825 A1* 5/2002 Sukaki ..... 420/83
2003/0062098 A1* 4/2003 Sakaki et al. ..... 148/102

FOREIGN PATENT DOCUMENTS

JP 57-061083 A1 4/1982
JP 04-010504 A1 1/1992
JP 08-260083 A1 10/1996
JP 2001-126908 * 5/2001

* cited by examiner

*Primary Examiner*—John P. Sheehan
(74) *Attorney, Agent, or Firm*—Darby & Darby P.C.

(57) ABSTRACT

The present invention relates to a Sm—Co based magnet alloy useful as a raw material for producing magnets having high magnetic properties, such as sintered or bonded magnets, methods for producing such an alloy, and sintered or bonded magnets having excellent corrosion resistance and high magnetic properties, such as high coercivity and good squareness. The magnetic alloy is composed of an alloy represented by the formula RM with 32.5 to 35.5 wt % R such as Sm and the balance of M such as Co, wherein ratio (B/A) of the X-ray diffraction intensity (B) corresponding to the (119) plane of $R_2M_7$ phase to the X-ray diffraction intensity (A) corresponding to the (111) plane of $RM_5$ phase is not higher than 0.1.

11 Claims, No Drawings

ALLOY FOR SM-CO BASED MAGNET, METHOD FOR PRODUCTION THEREOF, SINTERED MAGNET AND BONDED MAGNET

FIELD OF ART

The present invention relates to Sm—Co based magnet alloys, methods for producing the same, and sintered or bonded magnets using the Sm—Co based magnet alloy.

BACKGROUND ART

Reduction-diffusion process (RD process) is known for producing Sm—Co based magnet alloys, and is now in practical use. The RD process involves heating oxides of the rare earths and the other constituent metals with a reducing agent such as metallic calcium or calcium hydride, in an inert atmosphere to reduce the rare earth oxides into metals, which are simultaneously diffused into the other constituent metals. The reaction product is then cooled to the room temperature, and introduced into water to dissolve and remove the reduction products, such as CaO, $CaO.2CaCl_2$, and $Ca(OH)_2$, and unreacted residual metallic calcium. The resulting product may optionally be subjected to an acid treatment.

Another method in practical use is a casting method which involves blending the constituent rare earth metals and other metals, or master alloys consisting of these constituent metals, at a given composition, high-frequency induction melting, and casting the alloy melt in a mold to have a thickness of about 50-100 mm. Also proposed is a method, which has been under consideration, and involves blending the constituent rare earth metals and other metals, or master alloys consisting of these constituent metals, at a given composition, and high frequency induction melting, as in the above mold casting method, and then rapidly cooling and solidifying the alloy melt continuously by strip casting on a single or double rolls or on a disk.

In the Sm—Co based magnet alloys produced by the RD process, the adhesive and aggregates, such as CaO, $CaO.2CaCl_2$, and $Ca(OH)_2$ or unreacted residual metallic calcium, have not been removed completely, and are present at about 50 to 2000 ppm, which lower corrosion resistance. Further, since the RD process involves contacting the alloy with water or the like medium, the oxide content of the resulting Sm—Co based magnet alloy becomes as high as 1000 to 2500 ppm. This increases the volume of the non-magnetic phase, and thus deteriorates magnetic properties.

The mold casting, on the other hand, solves the problem of lowered corrosion resistance encountered in the RD process. However, when a cast ingot is pulverized, coarse particles are in the pulverized particles. These coarse particles lower magnetic properties to a similar level as can be achieved by the RD process.

A Sm—Co based magnet alloy prepared by conventional strip casting contains a relatively large amount of $R_2M_7$ and $RM_3$ phases having lower magnetic moment than that of $RM_5$ phase. Thus magnetic properties of this alloy are inferior to those produced by the RD process or mold casing.

SUMMARY OF THE INVENTION

It is therefore an object of the present invention to provide a Sm—Co based magnet alloy that is quite useful as a raw material for production of magnets having high magnetic properties, such as sintered or bonded magnets, as well as a method for producing the alloy.

It is another object of the present invention to provide a Sm—Co based sintered or bonded magnet having excellent corrosion resistance and high magnetic properties, such as high coercive force and good squareness.

According to the present invention, there is provided a Sm—Co based magnet alloy consisting of an alloy represented by the formula RM with 32.5 to 35.5 wt % R and the balance of M, wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, wherein a ratio (B/A) of an X-ray diffraction intensity (B) corresponding to (119) plane of $R_2M_7$ phase to an X-ray diffraction intensity (A) corresponding to (111) plane of $RM_5$ phase is not higher than 0.1 (sometimes referred to as alloy (a) hereinbelow).

According to the present invention, there is also provided a method for producing alloy (a) comprising cooling an alloy melt of 32.5 to 35.5 wt % raw material alloy for R and the balance of raw material alloy for M from a melting point of said alloy to 800° C. over 0.5 to 20 seconds, and from 800° C. to 200° C. over not shorter than 600 seconds, wherein R and M are as defined above.

According to the present invention, there is further provided a method for producing alloy (a) comprising casting an alloy melt of 32.5 to 35.5 wt % raw material alloy for R and the balance of raw material alloy for M by strip casting at a cooling surface temperature controlled to be in a range of 200 to 600° C., wherein R and M are as defined above.

According to the present invention, there is also provided a method for producing alloy (a) comprising casting and cooling an alloy melt of 32.5 to 35.5 wt % raw material alloy for R and the balance of raw material alloy form in a mold whose cooling surface is controlled to be in a temperature range of 200 to 600° C., to have a thickness of 1 to 10 mm, wherein R and M are as defined above.

According to the present invention, there is further provided a Sm—Co based sintered magnet produced by pressing an alloy powder mixture in a magnetic field, followed by sintering, said alloy powder mixture consisting of powder of alloy (a) and powder of a Sm—Co based magnet blend alloy (sometimes referred to as blend alloy (b) hereinbelow), wherein said blend alloy (b) consists of an alloy represented by the formula $(R^1)(M^1)$ with $35.5<(R^1)\leqq 45.0$ in weight percent and the balance being $M^1$, wherein $(R^1)$ is Sm alone, or Sm in combination with at least one rare earth metal selected from the group consisting of Ce, Pr, Nd, and Gd, $(M^1)$ is Co alone, or Co in combination with at least one transition metal, provided that $(R^1)$ and $(M^1)$ may include inevitable elements.

According to the present invention, there is further provided a Sm—Co based bonded magnet produced by pressing a resin-containing mixture comprising alloy powder (a-1) and a resin material in a magnetic field, followed by sintering, wherein said alloy powder (a-1) has been prepared by solution heat treating, pulverizing, and aging heat treating alloy (a).

PREFERRED EMBODIMENTS OF THE INVENTION

The present invention will now be explained in detail.

Alloy (a) according to the present invention consists of an alloy represented by the formula RM, which has a particular crystal phase. R is Sm alone, or Sm in combination with at least one rare earth metal selected from the group consisting of Ce, Pr, Nd, and Gd. The Sm content in R is preferably 85 to 100 wt %. M is Co alone, or Co in combination with at least one transition metal, such as Cu, Fe, and Ni. The Co content in M is preferably 75 to 100 wt %. R and M may contain inevitable elements.

The compositional range of R and M is 32.5 to 35.5 wt % R and the balance of M, preferably 33.0 to 33.85 wt % R and the balance of M. With less than 32.5 wt % R, pulverizability of the alloy in the magnet production process is poor, resulting in unimproved magnetic properties. With more than 35.5 wt % R, $RM_5$ phase precipitation is reduced, and thus the contents of $R_2M_7$ and $RM_3$ phases are increased, resulting in unimproved magnetic properties.

Alloy (a) according to the present invention has a crystal phase wherein a ratio (B/A) of the X-ray diffraction intensity (B) corresponding to the (119) plane of $R_2M_7$ phase to the X-ray diffraction intensity (A) corresponding to the (111) plane of $RM_5$ phase is not higher than 0.1, preferably not higher than 0.08. With the (B/A) ratio of over 0.1, too much $R_2M_7$ phase is present to lower magnetic properties of the resulting magnet.

The X-ray diffraction intensities (A) and (B) refer to the relative peak heights corresponding to the (111) plane of $RM_5$ phase and to the (119) plane of $R_2M_7$ phase, respectively, read from the powder X-ray diffraction pattern of alloy (a) obtained by plotting the diffraction pattern intensity (%) (ordinate) against the diffraction angle (2θ) (abscissa).

A volume ratio of each crystal phase is presented as a ratio of the X-ray diffraction intensity at the maximum diffraction peak representing each crystal phase with respect to a reference value as a sum of the X-ray diffraction intensities at the maximum diffraction peaks of all the crystal phases, read from in the powder X-ray diffraction pattern.

Alloy (a) of the present invention contains, as a crystal phase, $RM_5$ phase, preferably at a content of not less than 85 vol %, more preferably 88 to 100 vol %. With less than 85 vol % $RM_5$ phase, relative contents of $R_2M_7$ and $RM_3$ phases in alloy (a) are increased, which results in the (B/A) ratio of over 0.1. In this case, magnetic properties of the resulting magnet may not be improved.

The oxygen content of the present alloy (a) is preferably not higher than 800 ppm, more preferably not higher than 500 ppm. With an oxygen content of over 800 ppm, too much non-magnetic phase is formed, which lowers magnetic properties.

The calcium content of the present alloy (a) is preferably not higher than 40 ppm, more preferably not higher than 10 ppm. In quantitative analysis of alloy components by ICP plasma emission spectroscopy, usually the minimum detectable calcium content is at best about 1 ppm. It is thus more preferred that calcium is not detected in quantitative analysis of the alloy components by ICP plasma emission spectroscopy. With the calcium content of not higher than 40 ppm, excellent corrosion resistance is achieved.

Alloy (a) of the present invention may be prepared, for example, by any of the following preparation methods according to the present invention.

The methods of the present invention include: a method including cooling an alloy melt of a raw material alloy for R and a raw material alloy for M blended to have the above RM composition, from the melting point of the alloy to 800° C. over 0.5 to 20 seconds, and from 800° C. to 200° C. over not shorter than 600 seconds (referred to as method (1) hereinbelow); a method including casting an alloy melt of a raw material alloy for R and a raw material alloy for M by strip casting at a cooling surface temperature controlled to be in the range of 200 to 600° C. (referred to as method (1) hereinbelow); or a method including casting and cooling an alloy melt of a raw material alloy for R and a raw material alloy for M in a mold whose cooling surface is controlled to be in a temperature range of 200 to 600° C., to have a thickness of 1 to 10 mm (referred to as method (3) hereinbelow). Sometimes, the above methods (1) to (3) are collectively referred to as the method of the present invention.

In the method of the present invention, the alloy melt of a raw material alloy for R and a raw material alloy for M may be prepared by melting the raw material alloy for R and the raw material alloy for M adjusted to a particular ratio, for example, in an inert gas atmosphere by vacuum induction melting, high frequency induction melting, or the like melting method.

In method (1), cooling of the alloy melt from its melting point to 800° C. is performed over 0.5 to 20 seconds, preferably 1 to 5 seconds. In less than 0.5 seconds of cooling, crystals do not grow (i.e. dendrite is not formed) and instead fine equiaxed microstructure (chill) is formed. Thus no crystal orientation is observed, and Br is not improved. With the cooling time lasting over 20 seconds, $R_2M_7$ phase precipitates, which leads to a reduced Br. In order to achieve proper crystal orientation, and prevent the $R_2M_7$ phase precipitation, it is preferred that the alloy melt is cooled from its melting point to 800° C. over 0.5 to 20 seconds.

In method (1), next, cooling of the alloy melt from 800° C. to 200° C. is performed over not shorter than 600 seconds. In less than 600 seconds of cooling, crystals do not grow sufficiently, and when the resulting alloy is pulverized, the obtained powder does not become uniaxial, leading to a reduced Br. The maximum cooling time is not particularly defined, but it is preferred to complete the cooling within 1 hour for production efficiency and energy efficiency.

In method (1), the temperature of the alloy melt means, in the case of cooling by mold casting, the temperature in approximately the center of the alloy melt cast in the mold, i.e., the temperature measured by inserting a thermocouple from approximately the center of the upper surface of the alloy melt cast in the mold in the direction of the thickness to half the height of the alloy melt. In the case of preparing alloy ribbons by strip casting, the temperature of the alloy melt means the surface temperature of the alloy melt and the alloy ribbons measured by means of an infrared thermal image analyzer.

The cooling rate of the alloy melt in method (1) may be controlled in any manner, for example, by method (2) or (3) mentioned above.

In method (2), the strip casting may be continuous solidification using conventional cooling means such as a single roll, double rolls, or a disk. In this method (2), the alloy melt is cast, for example, with the surface temperature of the roll(s) or the disk being controlled to be within the range of 200 to 600° C., preferably 300 to 500° C., from commencement to completion of the casting.

The temperature of the cooling surface may be controlled, for example, by preheating the surface with a heater to be within the controlled temperature range before commencement of casting, and maintaining the temperature within the range by controlling the temperature of the alloy melt, the rotational speed of the roll(s) or the disk, the casting speed of the alloy melt, the temperature of the circulating cooling medium, or the like factors. With the cooling surface at less than 200° C., the contents of $R_2M_7$ and $RM_3$ phases in the resulting alloy are increased to raise the (B/A) ratio beyond 0.1, resulting in unimproved magnetic properties of the objective magnet. With the cooling surface at higher than 600° C., the cast ribbons leave the cooling surface before being solidified, and may disadvantageously be fused with each other. It is preferred that the conditions of the strip casting are controlled so that the thickness of the resulting alloy ribbons falls within the range of 0.1 to 1.0 mm.

In method (2), the rate for cooling the alloy melt may suitably be selected from the cooling rate available by strip casting so that the crystal structure of alloy (a) of the present invention is obtained.

Method (3) mentioned above is a method of casting and cooling an alloy melt in a mold, wherein the cooling surface of the mold is controlled to be in the temperature range of 200 to 600° C., preferably 550 to 600° C. The temperature of the cooling surface may be controlled, for example, by preheating the mold with a heater to be within 200 to 600° C. before commencement of casting. The temperature control may also be made by suitably selecting the material, thickness, or the like factors of the mold. The alloy melt is cast in the mold to have a thickness of 1 to 10 mm, preferably 2 to 5 mm. By controlling the thickness to 1 to 10 mm, the time required for cooling the alloy melt from its melting point to 800° C. may be controlled to be within 0.5 to 20 seconds.

The Sm—Co based sintered magnet according to the present invention is prepared from, as a raw material, an alloy powder mixture containing powder of alloy (a) of the present invention and powder of blend alloy (b) consisting of an alloy of a particular composition represented by the formula $(R^1)(M^1)$.

In blend alloy (b), $(R^1)$ is Sm alone, or Sm in combination with at least one rare earth metal selected from the group consisting of Ce, Pr, Nd, and Gd. The Sm content in $(R^1)$ is preferably 85 to 100 wt %. $(M^1)$ is Co alone, or Co in combination with at least one transition metal, such as Cu, Fe, and Ni. The Co content in $(M^1)$ is preferably 75 to 100 wt %. $(R^1)$ and $(M^1)$ may contain inevitable elements.

The compositional range of $(R^1)$ and $(M^1)$ is $35.5<(R^1)\leqq 45.0$ and the balance of $(M^1)$, preferably $37.0\leqq(R^1)\leqq 44.0$ and the balance of $(M^1)$ in weight %. With more than 45.0 wt % $(R^1)$, problems will arise in the degree of sintering of the resulting sintered magnet, while with less than 35.5 wt % $(R^1)$, magnetic properties of the resulting sintered magnet are inferior.

Blend alloy (b) may preferably contain, as crystal phases, not more than 50 vol %, specifically not more than 44 vol % $(R^1)(M^1)_5$ phase; 10 to 40 vol %, specifically 15 to 35 vol % $(R^1)(M^1)_3$ phase; and 2 to 30 vol %, specifically 2 to 25 vol % $(R^1)(M^1)_2$ phase. With more than 50 vol % $(R^1)(M^1)_5$ phase, pulverizability of the alloy is poor, and the pulverized powder may contain coarse particles, which may lead to deterioration of the magnetic force of the resulting sintered magnet. Blend alloy (b) may contain a eutectic phase of R and M.

In the alloy powder mixture, the ratio of the powder of alloy (a) to the powder of blend alloy (b) is preferably selected so that the content of the rare earth metals including Sm in the alloy powder mixture is usually in the range of 35.0 to 36.0 wt %.

The average particle size of the powders of alloy (a) and blend alloy (b) may preferably be in the range of 2 to 6 μm for achieving sufficient degree of sintering of the resulting sintered magnet. Such particle size may be achieved, for example, by crushing and then finely pulverizing each alloy in a jet mill, or the like apparatus.

The Sm—Co based sintered magnet is produced by pressing the powder mixture in a magnetic field, and sintered. The pressing in a magnetic field may be performed by a conventional method in a magnetic field of usually 10 to 30 kOe/cm$^2$. The sintering may usually be performed in an argon atmosphere at 1050 to 1150° C., usually at about 1100° C., for 1 to 2 hours. The sintering may preferably be followed by a heat treatment at 800 to 900° C. for 2 to 4 hours. The obtained product may optionally be subjected to a grinding process to improve the dimensional accuracy, and then magnetized, to thereby obtain an objective sintered magnet having high coercivity and excellent squareness.

The Sm—Co based bonded magnet according to the present invention is prepared from, as a raw material, a resin-containing mixture containing a resin material and alloy powder (a-1) prepared by solution heat treating, pulverizing, and aging heat treating alloy (a).

Alloy (a) may be solution heat treated by holding the alloy in an argon atmosphere at 1150 to 1250° C., usually at about 1120° C., to effect solution treatment.

The solution heat treated alloy may be pulverized and aging heat treated into alloy powder (a-1) by, for example, pulverizing the alloy into powder of 20 to 70 μm in a crusher, a disk mill, or the like apparatus, and aging heat treating preferably at 800 to 900° C.

The resin-containing mixture is prepared by mixing and kneading alloy powder (a-1) with usually 1 to 3 vol % resin material that is used for bonded magnets, such as epoxy and nylon resins.

The Sm—Co based bonded magnet is produced by pressing the resin-containing mixture as a raw material in a magnetic field, followed by curing. The pressing in a magnetic field may be performed by press forming or injection molding at a pressure of 1 to 5 t/cm$^2$, usually in a magnetic field of 10 to 30 kOe/cm$^2$. The curing may be performed usually in an argon atmosphere at 100 to 150° C. For 1 to 2 hours.

EXAMPLES

The present invention will now be explained with reference to Examples and Comparative Examples, which are illustrative only and do not intend to limit the present invention.

Example 1

(Preparation of Sm—Co Based Magnet Alloy)

A metal mixture having a composition of 32.6 wt % Sm and 67.4 wt % Co was melted in an argon atmosphere in a vacuum high frequency induction furnace, and cast using a casting apparatus having a single water-cooled copper roll to obtain sample (1). Before commencement of the casting, the cooling surface of the roll was preheated to 350° C. with a heater. During casting, the temperature of the cooling surface of the roll was controlled to be within the range of 200 to 600° C. under monitoring with an infrared thermal image analyzer.

Sample (1) was pulverized and measured for X-ray diffraction intensity in an X-ray diffractometer (manufactured by RIGAKU CORPORATION, RINT2500). From the X-ray diffraction data, it was found that the ratio (B/A) of the X-ray diffraction intensity (B) corresponding to the (119) plane of $Sm_2Co_7$ phase to the X-ray diffraction intensity (A) corresponding to the (111) plane of $SmCo_5$ phase was 0.044, and that sample (1) contained 95 vol % $SmCo_5$ phase. Further, sample (1) was measured for oxygen and calcium contents, respectively, with an oxygen/nitrogen analysis device (manufactured by HORIBA LTD, EMGA-550FA) and an ICP plasma emission spectrometer (manufactured by SEIKO DENSHI K.K., SPS-1700HVR), respectively. The oxygen content of sample (1) was 130 ppm, and no calcium was detected. The results are shown in Table 1.

(Preparation of Sm—Co Based Magnet Blend Alloy)

A metal mixture having a composition of 37.5 wt % Sm and 62.5 wt % Co was melted in an argon atmosphere in a vacuum high frequency induction furnace, and cast using a casting apparatus having a water-cooled copper mold to obtain sample (1a) of 60 mm thick. Sample (1a) was pulverized and subjected to X-ray diffraction in the same way as above. It was found that sample (1a) contained 44 vol % $SmCo_5$ phase, 18 vol % $SmCo_3$ phase, and 2 vol % $SmCo_2$ phase. The results are shown in Table 2.

(Production of Sm—Co Based Sintered Magnet)

Samples (1) and (1a) prepared above were blended so that the Sm content was 35.8 wt %, crushed, and finely pulverized in a jet mill into powder having an average particle size of about 2 to 6 μm. Then the resulting powder mixture was pressed at a pressure of 5 t/cm$^2$ in a magnetic field of 30 kOe, and sintered at 1100° C. for 1 hour. The resulting sintered product was heat treated at 900° C. for 4 hours to obtain a Sm—Co based sintered magnet.

The Sm—Co based sintered magnet thus produced was measured for magnetic properties and corrosion resistance. The results are shown in Table 3. The corrosion resistance was evaluated by exposing the Sm—Co based sintered magnet in the environment of 80% humidity at 80° C. for 24 hours, and then measuring the percentage of the rust area. Thus a lower rust area ratio indicates better corrosion resistance.

Examples 2 to 10 and Comparative Example 1 to 6

Samples (2) to (5) were prepared and subjected to the measurements in the same way as for sample (1) in Example 1, except that the Sm content was changed as shown in Table 1. Sample (6) was prepared and subjected to the measurements in the same way as for sample (1) in Example 1, except that the Sm content was changed as shown in Table 1, and that the casting was commenced with the cooling surface temperature of the roll being at 20° C. without preheating the roll with a heater, and proceeded without controlling the cooling surface temperature of the roll. Sample (7) of 60 mm thick was prepared and subjected to the measurements in the same way as for sample 1(a) in Example 1, except that the Sm content was changed as shown in Table 1, and that the casting apparatus having a single water-cooled copper roll was replaced with a casting apparatus having a water-cooled copper mold. Sample (8) of 5 mm thick was prepared and subjected to the measurements, wherein the Sm content was changed as shown in Table 1, and a casting apparatus having a water-cooled copper mold was used, with the mold being preheated with a heater before commencement of casting, and with the mold being maintained at 550° C. from the commencement of casting. The results are shown in Table 1.

Samples (2a) to (3a) were prepared and subjected to the measurements in the same way as for sample (1a) in Example 1, except that the Sm content was changed as shown in Table 2. Sample (4a) was prepared in the same way as for Sample (1a) in Example 1, except that the Sm content was changed as shown in Table 2, and the casting device having a water-cooled copper mold was replaced with a casting device having a single water-cooled copper roll, and subjected to the same measurements as in Example 1. The results are shown in Table 2.

A Sm—Co based sintered magnet was produced and subjected to the measurements of magnetic properties and corrosion resistance in the same way as in Example 1, except that the combination of the alloy samples show in Table 3 was adopted. In Comparative Example 6, a Sm—Co based magnet material containing 35.8 wt % Sm was prepared by reduction-diffusion process, and subjected to the same measurements of magnetic properties and corrosion resistance as in Example 1. The results are shown in Table 3. The oxygen and calcium contents of the Sm—Co based magnet material prepared in Comparative Example 6 were measured in the same way as in Example 1 to be 1500 ppm and 50 ppm, respectively.

TABLE 1

| | Sm Content (wt %) | $SmCo_5$ phase (wt %) | B/A ratio | Oxygen content (ppm) | Calcium content (ppm) | Time required for cooling from melting point to 800° C. | Time required for cooling from 800° C. to 200° C. |
|---|---|---|---|---|---|---|---|
| Sample (1) | 32.6 | 95 | 0.044 | 130 | Not Detected | 0.9 sec | 1000 sec |
| Sample (2) | 33.8 | 95 | 0.051 | 135 | Not Detected | 0.9 sec | 1000 sec |
| Sample (3) | 34.8 | 93 | 0.062 | 140 | Not Detected | 0.9 sec | 1000 sec |
| Sample (4) | 35.2 | 92 | 0.078 | 145 | Not Detected | 0.9 sec | 1000 sec |
| Sample (5) | 32.0 | 98 | 0.013 | 130 | Not Detected | 0.9 sec | 1000 sec |
| Sample (6) | 33.4 | 89 | 0.103 | 130 | Not Detected | 0.4 sec | 100 sec |
| Sample (7) | 33.8 | 84 | 0.185 | 135 | Not Detected | 330 sec | 2600 sec |
| Sample (8) | 33.8 | 94 | 0.056 | 135 | Not Detected | 2.5 sec | 2000 sec |

TABLE 2

| | Sm Content (wt %) | $SmCo_5$ phase (wt %) | $SmCo_3$ phase (wt %) | $SmCo_2$ phase (wt %) |
|---|---|---|---|---|
| Sample (1a) | 37.5 | 44 | 18 | 2 |
| Sample (2a) | 40.5 | 10 | 28 | 15 |
| Sample (3a) | 46.8 | 3 | 25 | 28 |
| Sample (4a) | 38.3 | 28 | 23 | 6 |

TABLE 3

| | Combination of alloy samples | Br (kG) | iHc (kOe) | BHmax (MGOe) | Squareness (%) | Corrosion resistance (%) |
|---|---|---|---|---|---|---|
| Example 1 | Sample (1) + Sample (1a) | 9.26 | 24.8 | 20.6 | 86 | 0.2 |
| Example 2 | Sample (1) + Sample (2a) | 9.25 | 24.5 | 20.6 | 85 | 0.2 |
| Example 3 | Sample (1) + Sample (4a) | 9.18 | 24.7 | 19.8 | 84 | 0.2 |
| Example 4 | Sample (2) + Sample (1a) | 9.45 | 24.8 | 21.0 | 89 | 0.2 |
| Example 5 | Sample (2) + Sample (2a) | 9.43 | 25.1 | 20.9 | 88 | 0.3 |
| Example 6 | Sample (3) + Sample (1a) | 9.21 | 24.8 | 20.5 | 85 | 0.2 |
| Example 7 | Sample (3) + Sample (2a) | 9.24 | 25.0 | 20.5 | 84 | 0.2 |
| Example 8 | Sample (4) + Sample (2a) | 9.12 | 24.7 | 19.7 | 82 | 0.3 |
| Example 9 | Sample (8) + Sample (1a) | 9.45 | 24.7 | 20.8 | 86 | 0.2 |
| Example 10 | Sample (8) + Sample (2a) | 9.40 | 24.9 | 20.6 | 86 | 0.2 |
| Comp. Ex. 1 | Sample (5) + Sample (2a) | 8.87 | 24.8 | 18.2 | 85 | 0.4 |
| Comp. Ex. 2 | Sample (6) + Sample (2a) | 8.72 | 24.5 | 18.1 | 78 | 0.3 |
| Comp. Ex. 3 | Sample (6) + Sample (4a) | 8.56 | 24.8 | 17.5 | 77 | 0.2 |
| Comp. Ex. 4 | Sample (7) + Sample (2a) | 9.08 | 24.6 | 18.9 | 74 | 0.7 |
| Comp. Ex. 5 | Sample (1) + Sample (3a) | 8.95 | 24.2 | 18.6 | 81 | 0.4 |
| Comp. Ex. 6 | — | 9.14 | 24.4 | 19.5 | 85 | 3.6 |

Examples 11 and 12

Alloy powder of sample (2) or (8) shown in table 1 was solution heat treated at 1120° C. For 1 hour, pulverized in a disk mill into powder having an average particle size of 20 to 60 μm, and aging heat treated at 900° C. For 4 hours. The resulting powder was kneaded with 2 vol % epoxy resin to prepare a resin-containing mixture. This resin-containing mixture was pressed at a pressure of 5 t/cm$^2$ in a magnetic field of 30 kOe, and cured at 150° C. For 2 hours, to obtain a bonded magnet. The bonded magnet thus produced was measured for magnetic properties in the same way as in example 1. The results are shown in table 4.

Comparative Example 7

A bonded magnet was prepared and subjected to the measurements in the same way as in Example 9, except that sample (2) or (8) was replaced with sample (7). The results are shown in Table 4.

TABLE 4

| | Kind of Sample | Br (kG) | iHc (kOe) | BHmax (MGOe) | Squareness (%) |
|---|---|---|---|---|---|
| Example 11 | Sample (2) | 6.04 | 23.2 | 13.3 | 82 |
| Example 12 | Sample (8) | 6.08 | 23.2 | 12.9 | 80 |
| Comp. Ex. 7 | Sample (7) | 5.84 | 22.8 | 11.6 | 78 |

The Sm—Co based magnet alloy according to the present invention has a particular composition and a particular crystal structure, so that this alloy is extremely useful as a raw material for producing magnets having high magnetic properties, such as sintered magnets or bonded magnets. The method according to the present invention allows efficient manufacturing of such an alloy.

The Sm—Co based sintered or bonded magnets according to the present invention are produced with the Sm—Co based magnet alloy of the present invention, so that the magnets exhibit excellent corrosion resistance and high magnetic properties (high coercivity and good squareness).

What is claimed is:

1. A method of producing a Sm—Co based magnet alloy consisting of an alloy represented by the formula RM with 32.5 to 35.5 wt % R and the balance of M, wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, wherein a ratio (B/A) of an X-ray diffraction intensity (B) corresponding to (119) plane of $R_2M_7$ phase to an X-ray diffraction intensity (A) corresponding to (111) plane of $RM_5$ phase is not higher than 0.1, said method comprising cooling an alloy melt of 32.5 to 35.5 wt % raw material alloy for R and the balance of raw material alloy for M from a melting point of said alloy to 800° C. over 0.5 to 20 seconds, and from 800° C. to 200° C. over not less than 600 seconds.

2. A method for producing a Sm—Co based magnet alloy consisting of an alloy represented by the formula RM with 32.5 to 35.5 wt % R and the balance of M, wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, wherein a ratio (B/A) of an X-ray diffraction intensity (B) corresponding to (119) plane of $R_2M_7$ phase to an X-ray diffraction intensity (A) corresponding to (111) plane of $RM_5$ phase is not higher than 0.1, said method comprising casting an alloy melt of 32.5 to 35.5 wt % raw material alloy for R and the balance of raw material alloy for M by strip casting at a cooling surface temperature controlled to be in a range of 200 to 600° C.

3. The method according to claim 1, wherein said cooling is conducted by casting and cooling said alloy melt in a mold whose cooling surface is controlled to be in a range of 200 to 600° C. to have a thickness of 1 to 10 mm.

4. A method of producing a Sm—Co based sintered magnet comprising:

preparing an alloy (a) represented by the formula RM with 32.5 to 35.5 wt % R and the balance of M, by cooling an alloy melt of 32.5 to 35.5 wt % raw material alloy for R and the balance of raw material alloy for M from a melting point of said alloy to 800° C. over 0.5 to 20 seconds, and from 800° C. to 200° C. over not less than 600 seconds, wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, said alloy (a) having a ratio (B/A) of an X-ray diffraction intensity (B) corresponding to (119) plane of $R_2M_7$ phase to an X-ray diffraction intensity (A) corresponding to (111) plane of $RM_5$ phase of not higher than 0.1;

preparing a Sm—Co based magnet blend alloy consisting of an alloy (b) represented by the formula $(R^1)(M^1)$ with $35.5<(R^1)\leqq 45.0$ in weight percent and the balance being $M^1$, wherein $(R^1)$ is Sm alone, or Sm in combination with at least one rare earth metal selected from the group consisting of Ce, Pr, Nd, and Gd, $(M^1)$ is Co alone, or Co in combination with at least one transition metal, provided that $(R^1)$ and $(M^1)$ may include inevitable elements;

crushing and finely pulverizing said alloys (a) and (b) to obtain an alloy powder mixture; and pressing said alloy powder mixture in a magnetic field, followed by curing.

5. The method according to claim 4, wherein said cooling of an alloy melt is conducted by casting and cooling said alloy melt in a mold whose cooling surface is controlled to be in a range of 200 to 600° C. to have a thickness of 1 to 10 mm.

6. The method according to claim 4, wherein said alloy (b) comprises not more than 50 vol % $(R^1)(M^1)_5$ phase, 10 to 40 vol % $(R^1)(M^1)_3$ phase, and 2 to 30 vol % $(R^1)(M^1)_2$ phase.

7. A method of producing a Sm—Co based sintered magnet comprising:

preparing an alloy (a) represented by the formula RM with 32.5 to 35.5 wt % R and the balance of M, by casting an alloy melt of 32.5 to 35.5 wt % raw material alloy for R and the balance of raw material alloy for M by strip casting at a cooling surface temperature controlled to be in a range of 200 to 600° C., wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, said alloy (a) having a ratio (B/A) of an X-ray diffraction intensity (B) corresponding to (119) plane of $R_2M_7$ phase to an X-ray diffraction intensity (A) corresponding to (111) plane of $RM_5$ phase of not higher than 0.1;

preparing a Sm—Co based magnet blend alloy consisting of an alloy (b) represented by the formula $(R^1)(M^1)$ with $35.5<(R^1)\leqq 45.0$ in weight percent and the balance being $M^1$, wherein $(R^1)$ is Sm alone, or Sm in combination with at least one rare earth metal selected from the group consisting of Ce, Pr, Nd, and Gd, $(M^1)$ is Co alone, or Co in combination with at least one transition metal, provided that $(R^1)$ and $(M^1)$ may include inevitable elements;

crushing and finely pulverizing said alloys (a) and (b) to obtain an alloy powder mixture; and pressing said alloy powder mixture in a magnetic field, followed by curing.

8. The method according to claim 7, wherein said alloy (b) comprises not more than 50 vol % $(R^1)(M^1)_5$ phase, 10 to 40 vol % $(R^1)(M^1)_3$ phase, and 2 to 30 vol % $(R^1)(M^1)_2$ phase.

9. A method of producing a Sm—Co based bonded magnet comprising:

preparing an alloy (a) represented by the formula RM with 32.5 to 35.5 wt % R and the balance of M, by cooling an alloy melt of 32.5 to 35.5 wt % raw material alloy for R and the balance of raw material alloy for M from a melting point of said alloy to 800° C. over 0.5 to 20 seconds, and from 800° C. to 200° C. over not less than 600 seconds, wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, said alloy (a) having a ratio (B/A) of an X-ray diffraction intensity (B) corresponding to (119) plane of $R_2M_7$ phase to an X-ray diffraction intensity (A) corresponding to (111) plane of $RM_5$ phase of not higher than 0.1;

preparing a magnet alloy powder by solution heat treating, pulverizing and aging heat treating said alloy (a);

mixing said magnet alloy powder with a resin material to prepare a resin-containing mixture; and pressing said resin-containing mixture in a magnetic field, followed by curing.

10. The method according to claim 9, wherein said cooling of an alloy melt is conducted by casting and cooling an alloy melt in a mold whose cooling surface is controlled to be in a range of 200 to 600° C. to have a thickness of 1 to 10 mm.

11. A method of producing a Sm—Co based bonded magnet comprising:

preparing an alloy (a) represented by the formula RM with 32.5 to 35.5 wt % R and the balance of M, by casting an alloy melt of 32.5 to 35.5 wt % raw material alloy for R and the balance of raw material alloy for M by strip casting at a cooling surface temperature controlled to be in a range of 200 to 600° C., wherein R is Sm alone, or Sm in combination with at least one rare earth metal selected from the group consisting of Ce, Pr, Nd, and Gd, M is Co alone, or Co in combination with at least one transition metal, provided that R and M may include inevitable elements, said alloy having a ratio (B/A) of an X-ray diffraction intensity (B) corresponding to (119) plane of $R_2M_7$ phase to an X-ray diffraction intensity (A) corresponding to (111) plane of $RM_5$ phase of not higher than 0.1;

preparing a magnet alloy powder by solution heat treating, pulverizing and aging heat treating said alloy (a);

mixing said magnet alloy powder with a resin material to prepare a resin-containing mixture; and pressing said resin-containing mixture in a magnetic field, followed by curing.

* * * * *